United States Patent [19]

Zodrow et al.

[11] Patent Number: 4,721,544

[45] Date of Patent: Jan. 26, 1988

[54] WRAP-AROUND HOT-MELT LABELLING MACHINE

[75] Inventors: Rudolf Zodrow, Düsseldorf; Wolfgang Rogall, Wuppertal; Hans-Werner Mohn, Kaarst, all of Fed. Rep. of Germany

[73] Assignee: Jagenberg AG, Dusseldorf, Fed. Rep. of Germany

[21] Appl. No.: 855,581

[22] Filed: Apr. 24, 1986

[30] Foreign Application Priority Data

Apr. 27, 1985 [DE] Fed. Rep. of Germany ..... 3515324

[51] Int. Cl.[4] ..... B65C 9/04; B65C 9/16; B65C 9/20

[52] U.S. Cl. ..... 156/456; 156/458; 156/567; 156/578; 156/DIG. 26; 156/DIG. 29; 156/DIG. 32; 156/DIG. 34

[58] Field of Search ..... 156/446, 447, 448, 451, 156/458, 567, 578, DIG. 13, DIG. 26, DIG. 27, DIG. 29, DIG. 32, 456, DIG. 34

[56] References Cited

U.S. PATENT DOCUMENTS 4,531,995 7/1985 Gau ..... 156/567
4,594,123 6/1986 Eder ..... 156/DIG. 29

FOREIGN PATENT DOCUMENTS 3121359 12/1982 Fed. Rep. of Germany .
3307662 9/1984 Fed. Rep. of Germany .

OTHER PUBLICATIONS

Vorwort Zum Handbuch Der Etikettiertechnik: Hermann Kronseder; published 1975; West Germany; pp. 20 & 21.

*Primary Examiner*—Michael Wityshyn
*Attorney, Agent, or Firm*—Karl F. Ross; Herbert Dubno

[57] ABSTRACT

Wrap-around labels are applied with a hot-melt adhesive in a labelling machine in which upstream of the label box, the containers have the glue or adhesive applied to them by at least one, and preferably two, alternately operable nozzles while the rotary plates on which the containers are mounted are temporarily held stationary. This provides for highly precise gluing and the containers can then be rotated counter to the direction of rotation of the turntable carrying the plates at the label box so that a precise removal of the wrap-around label from the box is effected without allowing glue to accumulate on other labels in the box and impairing the labelling operation.

7 Claims, 3 Drawing Figures

WRAP-AROUND HOT-MELT LABELLING MACHINE

FIELD OF THE INVENTION

Our present invention relates to a labelling machine and, more particularly, to a labelling machine for applying wrap-around labels labels to containers, usually bottles, so that the labels are adhered to the containers with a hot-melt adhesive adhesive or glue.

BACKGROUND OF THE INVENTION

It is known to provide a labelling machine for applying wrap-around labels utilizing a suitable adhesive or glue to containers, such as bottles, with the end of the turntable having a plurality of rotary plates spaced angularly apart on the turntable and adapted to be driven, as the turntable itself rotates, to rotate the bottles on the turntable as they are moved along a generally circular path. Adjacent this path is a label box which comprises a magazine from which individual labels may be drawn and, upstream of this label box, a first gluing device is provided for transferring glue to the containers, whereby the glue on the container, when it reaches the label box, can pick-up an individual label which, during subsequent movement of the containers along the path, can be pressed against the glue-carrying surface of the container. Downstream of the label box, in the direction of rotation of the turntable and hence in the direction of entrainment of the containers, is a second gluing device which is designed to apply to an end of a label since, with wrap-around labels, one end of each label will overlie another end thereof directly, rather than a surface of the container having exposed glue, the overlapped end being thereby adhered in place.

A labelling machine of the aforementioned type is described in German patent document DE-OS No. 33 07 662. A vertical strip of glue is applied to the outer periphery of the containers passing by, for example tins, by means of the first gluing device arranged as a gluing roller on the outer side of the turntable.

The containers provided in this way with a strip of glue, pass both the label box as well as the second gluing device provided there with continuous auto rotation with a direction of rotation opposing the direction of rotation of the turntable.

During the movement of the containers past the label box, the containers roll with their glued area on the initial area of the front wrap-around label in the label box, due to which the latter is removed from the label box and then completely wrapped around before the previously glued end of the label sticks to the end of the label removed first.

Then the containers, continuing to rotate in the same direction, pass to a brushing-down station, where the wrap-around labels are pressed firmly against the containers and smoothed.

Due to the use of a glue-applicator roller for the first gluing device, there is no accurately defined and exact gluing, particularly in the case of soft containers, such as, for example, plastic bottles or, however, also containers, bottles or the like which have a slightly varying diameter on account of manufacturing tolerances.

On account of the imprecise application of glue to the periphery of the containers rotating continuously about their own axes in the opposite direction to that of the turntable strands of glue, which cannot be avoided, tend to spread, i.e. glue passes beyond the peripheries of the containers moved by way of the turntable into the region of the label box. Here the glue can extend beyond the front edge of the front wrap-around label to be removed, and penetrate into the stack of labels. Consequently, it cannot always be ensured that only one wrap-around label will be removed; there is an ever-present danger that several labels may stick together and be removed at the same time, which can lead to considerable disruption.

German patent document DE-OS No. 31 21 359 discloses a labelling machine in which glue application members in the form of spray nozzles of an additional gluing device are provided. Immediately before the transfer of the glued labels to the containers, hot-melt adhesive can be applied by means of these application members to one or more points in the region of the container to be labelled. Such an additional gluing device is used, above all, when difficult labelling conditions exist, such as is the case for example when rectangular or square bottles are to be labelled. With bottles of this type, on account of their adherent tension, the labels will become detached from from the bottle in their edge regions.

OBJECTS OF THE INVENTION

It is the principal object of the present invention to provide an improved labelling machine especially for the hot-melt application of wrap-around labels to bottles and other containers.

Still another object of this invention, is to avoid in an improved labelling machine, drawbacks of prior art systems, e.g. of the type described.

It is an object of the invention to provide a labelling machine of the aforementioned type suitable for applying wrap-around labels to containers, in particular, bottles or the like, which with a simple construction and which can be easily adapted to the given conditions, ensures exact, accurately defined gluing on the periphery of the containers, bottles or the like and reliable and precise transfer of the labels.

SUMMARY OF THE INVENTION

These objects are achieved according to the invention by providing as gluing device upstream of the label box which acts directly on the containers and comprises at least one spray nozzle and is located in the area inside the revolving turntable.

Due to the use of at least one and preferably two spray nozzles, an exactly defined application of glue can be provided and transferred by way of the containers into the region of the label box and there an exact and reliable removal solely of the front wrap-around label is achieved.

The danger that an overhanging quantity of the hot-melt adhesive will penetrate below the first wrap-around label of the labels located in the label box or prevent the front end of the wrap-around label from being applied cleanly to the periphery of the container or bottle, as is possible in the prior art, does not exist.

According to the invention, therefore, the labelling machine can comprise a turntable rotatable in a given direction and formed with a multiplicity of stations for respective containers to be labelled angularly equispaced about an axis of rotation of the turntable, each of the stations being provided with a respective rotary plate upon which a respective container is to be received.

A label box is positioned along the turntable and provided with a magazine for applying individual wrap-around labels from a stack thereof contained in the magazine to individual ones of the container as they are rotatably entrained by the turntable past the box and are rotated on their respective plates concurrently with their rotatable entrainment by the turntable past the box.

A first gluing device is provided upstream of the label box in the direction along the turntable and includes at least one hot-melt glue-spray nozzle located within a path of the containers entrained by the turntable and trained outwardly upon the containers entrained along the path for applying a hot-melt glue to each container, the hot-melt glue on each container causing a leading end of a respective wrap-around label from the label box to adhere to the container when each container reaches the label box.

A second gluing device is located downstream of the label box in the direction along the turntable and is positioned to apply glue to a trailing end of a label adapted to adhere last to the respective container to bond to a leading end of the label whereby the trailing end can overlap and bond to the leading end. Means is provided downstream of the second gluing device along the path for pressing the labels against the containers as the containers are rotated on the respective plates and are entrained along the path beyond the second gluing device.

According to the invention, the first gluing device comprises two alternately effective hot-melt glue-spray nozzles located within the path of the containers entrained by the turntable and trained outwardly upon the containers entrained along the path for applying the hot-melt glue to each container.

The labelling machine can have means operatively connected with the plates for preventing the plates from rotating while the respective containers thereon are juxtaposed with the nozzle.

Means can be operatively connected with the plates for causing the plates with respective containers thereon to rotate in a direction opposite the direction of rotation of the turntable downstream along the path from the gluing devices.

The labelling machine can also include means operatively connected with the plates for causing the plates with respective containers thereon to rotate in a direction which is the same as the direction of rotation of the turntable between the first gluing device and the label box, and then causing the plates to rotate in a direction opposite to the direction of rotation of the turntable for removing a respective label from the box.

The plates are each provided with a compact gear unit surrounded by a housing with a corresponding set of transmission gears for rotating the plates in selectively in a direction which is the same as the direction of rotation of the turntable and in a direction which is opposite to the direction of rotation of the turntable at different regions along the path.

Finally, the plates are each provided with a centering device for supporting the respective containers thereagainst.

It will be understood, that according to the capacity of the labelling machine, several spray nozzles may also be provided, which are used alternately, i.e. supply glue solely to every other container or bottle. The capacity-related control necessary for this can be put into effect by an automatic switching device.

With the design of the glue application, according to the invention, on the periphery of the containers, bottles or the like, one has the possibility of achieving multiple applications of the glue application device by a suitable control of the drive for the rotary plates.

Thus it is appropriate, that the rotary plates supporting the containers, bottles or the like, be prevented from rotating about their axes of rotation while the hot glue is being sprayed onto the containers, bottles or the like. This provides the possibility of achieving an even better and controlled glue application, i.e. possibly of increasing the receiving glue area.

Advantageously, after the application of glue to the periphery of the containers, bottles or the like , the rotary plates are set in revolution in the opposite direction to the direction of rotation of the turntable. First of all, i.e. during the application of the glue, the rotary plates are kept relatively stationary and then set in rotation. This can take place with the interposition of transmission gearing, so that with a suitable transmission ratio, two revolutions of the rotary plate or of the container, bottle or the like are necessary from the spraying of the glue until the complete wrapping around of the wrap-around label. Transmission gearing of this type can be used in a closed construction and driven by way of a double groove cam with corresponding roller guidance and can thus be located in the smallest place, in order that it can be used for smallest machine spacings.

However, it is also conceivable that after the application of glue to the peripheral area of the containers, bottles or the like until shortly before the removal of a wrap-around label from the label box, the rotary plates are driven about their axes of rotation in the direction of rotation of the turntable and in the opposite direction for receiving the wrap-around label.

Such a drive of the rotary plates or such a sequence of movements of the containers, bottles or the like, using corresponding transmission gearing, has the considerable advantage that from spraying of the hot glue onto the periphery of the containers, bottles or the like, only a rotation of the rotary plates of approximately 210 degrees is required, in order to remove the front wrap-around label from the box by rotating back in the opposite direction, in order to ensure complete application of a wrap-around label with a rotary movement of approximately 570 degrees.

With a control of the rotary plates of this type, only an angle of rotation of approximately 180 degrees is necessary for the removal of a wrap-around label from the box. This results in a considerable reduction in the setting time of the hot glue applied.

BRIEF DESCRIPTION OF THE DRAWING

The above and other objects, features and advantages of the present invention will become more readily apparent from the following highly diagrammatic drawing, in which.

SPECIFIC DESCRIPTION

Figure 1:
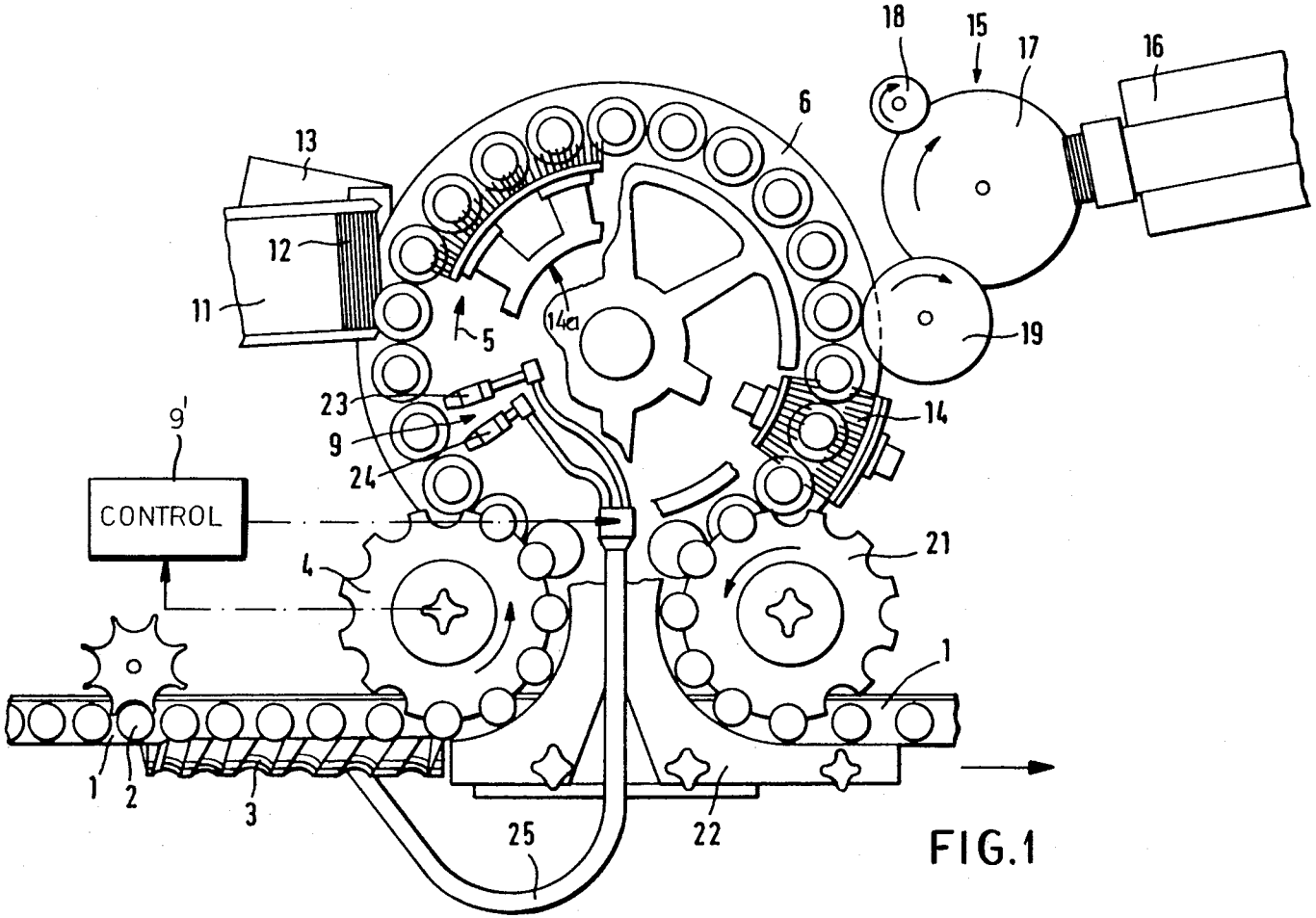
FIG. 1 is a diagrammatic plan view of a labelling machine, in which case the machine housing and the upper part of the turntable with the centering bell caps is omitted.

The labelling machine illustrated in FIG. 1 comprises a conveyer belt 1 for supplying bottles 2, which are given a predetermined spacing by means of a feed worm 3 and then transferred by an inlet drum 4 to a turntable 6 revolving continuously in the direction of arrow 5.

Figure 3:
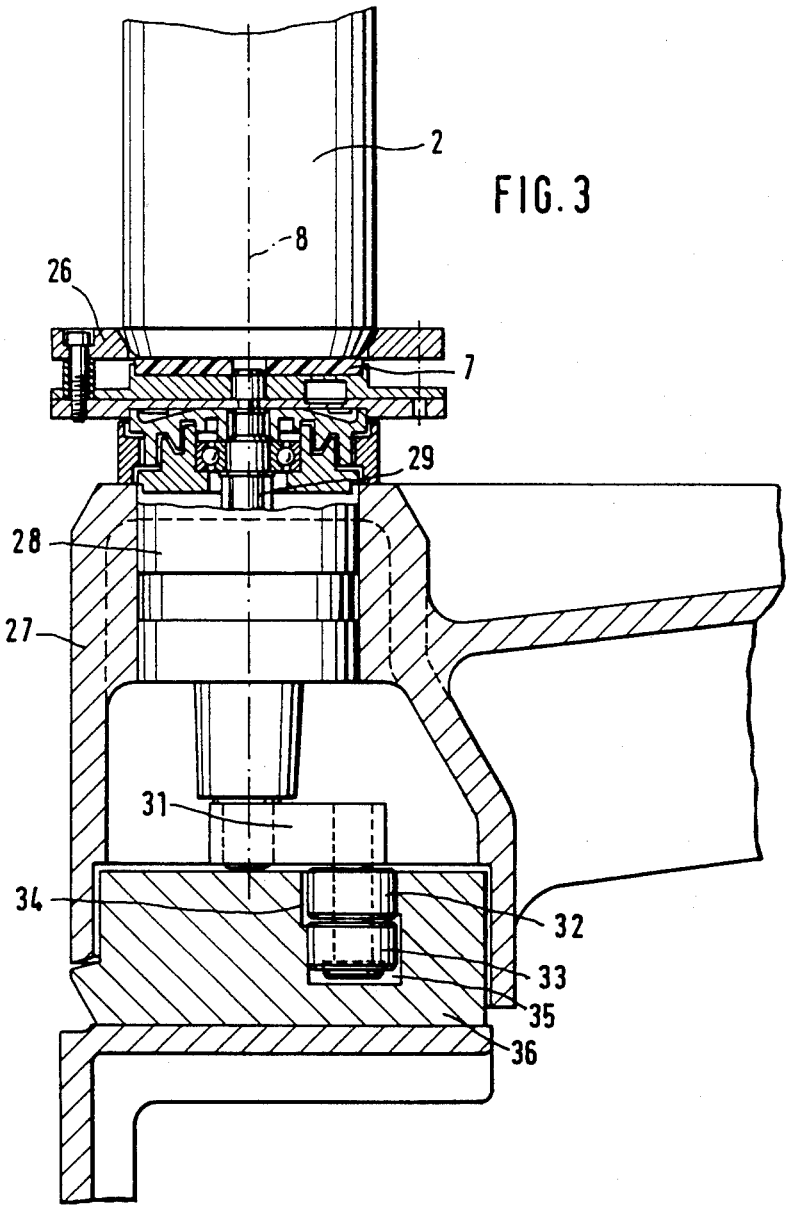
FIG. 3 is a vertical longitudinal section through a rotary plate with a centering device for the container, bottle or the like to be received and a support for the rotary plate to an enlarged scale.

The bottles 2 are mounted on rotary plates 7 of the turntable 6 by centering bell caps which can be raised and lowered (not shown) of an upper part of the turntable 6 which is likewise not shown, so that the bottles follow the respective auto rotation of the rotary plates 7 about an axis of rotation 8 shown in FIG. 3 with respect to the turntable 6.

The bottles 2 on the turntables 6 firstly pass a first gluing device 9 located inside the turntable 6, by which the bottles 2 can be provided with an exactly defined application of glue in a manner described in detail hereafter.

The moving bottles 2 arrive in the region of a substantially stationary label box 11, in which wrap-around labels 12 are stored in known manner.

A second gluing device 13 is associated with the rear ends of the wrap-around labels 12 seen in the direction of rotation of the turntable 6, by means of which device the rear ends of the labels can be provided with an application of glue.

As soon as the bottle is in the region of the label box 11, due to the glue applied to the periphery of the bottles 2 by the first gluing device 9, the front end of the wrap-around label 12 is pulled out of the label box 11 and wound completely around the bottle as a result of the continuing movement of the turntable 6, until finally the end of the label glued by the second gluing device 13 sticks to the end of the label removed first.

After this, the bottles 2 rotating further, pass through a brushing-down station 14*a*, where the wrap-around labels 12 are pressed down firmly onto the bottles 2 and smoothed. Then, if necessary, the bottles pass through a labelling station 15 for applying further labels, such as, for example, body or neck labels. The labelling station 15 consists in known manner of a label box 16, a removal member support 17, a gluing roller 18 and a gripper cylinder 19.

Another brushing-down station 14 is located behind the labelling station 15.

After passing through this brushing-down station, and further removing the centering bell caps, the bottles are received by an outlet drum 21 and deposited on the conveyer belt 1 discharging the labelled bottles. The bottles are guided exactly by a guide plate 22 in the region of the inlet drum 4 and the outlet drum 21.

In the embodiment illustrated, the first gluing device 9 consists of two spray nozzles 23, 24, which are connected by a pipe 25 to a glue container which is not shown. The spray nozzles 23, 24 can be operated alternately by way of a control 9', i.e. a first bottle is supplied with glue by means of the spray nozzle 23 and the following bottle is supplied with glue by means of the spray nozzle 24.

In a first variation, the bottles 2 may be supplied with glue by the spray nozzles 23 and 24 in an exactly defined manner.

In this case, the rotary plates 7 and thus the bottle stand relatively still, i.e. they do not rotate about their own axis, but move solely together with the turntable 6 in the direction of arrow 5.

Immediately after the application of glue, the rotary plates are driven so that they rotate continuously in the opposite direction to that of the turntable, so that the glue applied arrives in the region of the front edge of the front wrap-around label 12 to be removed from the label box 11.

With a corresponding arrangement of the spray nozzles 23 and 24 and a corresponding drive of the rotary plates, as is described hereafter with reference to FIG. 3, in this case, the bottle carries out a rotary movement of approximately 720 degrees, until from the spraying of the glue by the gluing device 9, the complete wrap-around label 12 is applied to the bottle.

Figure 2:
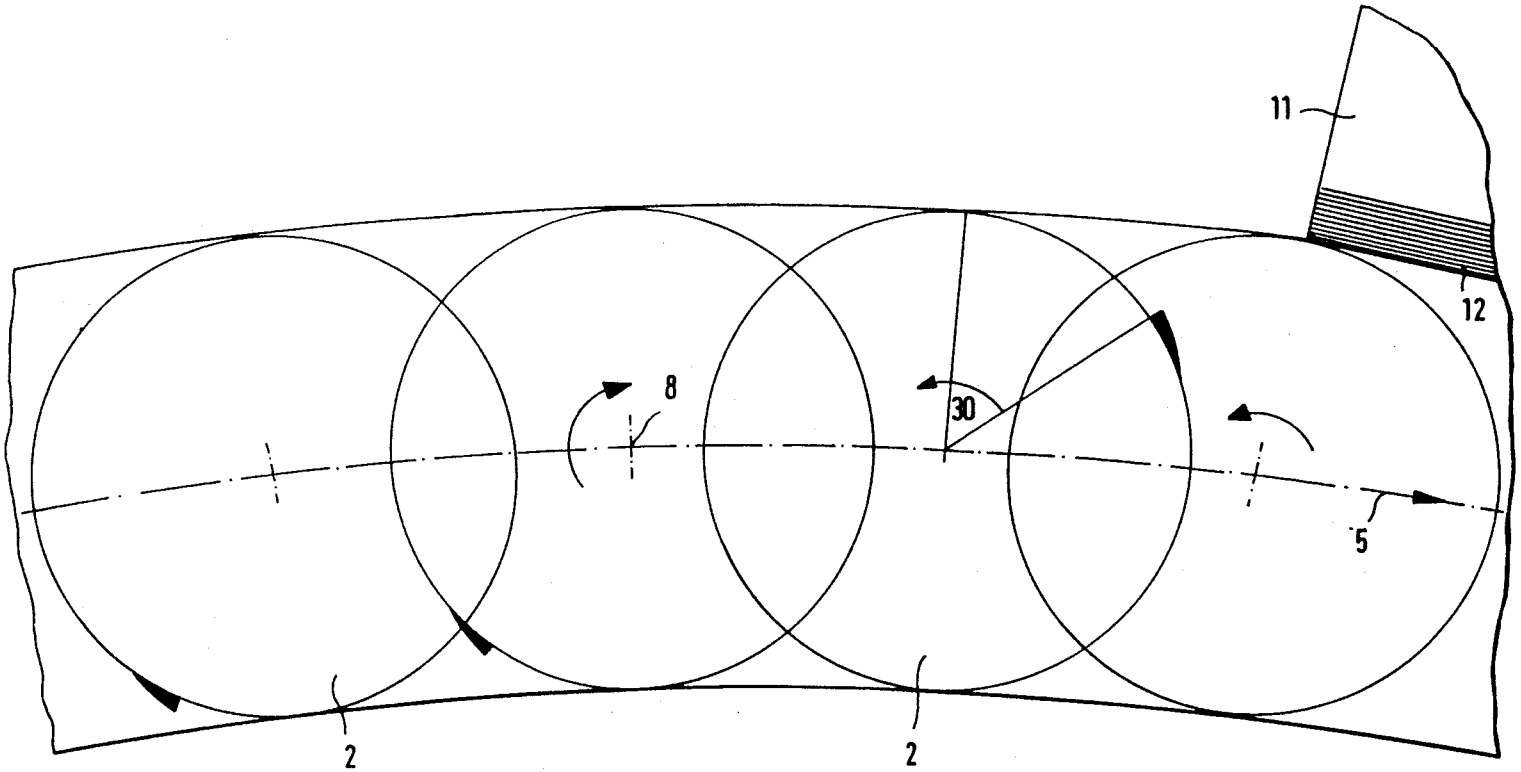
FIG. 2 is a diagram which shows the sequence of movements of the containers, bottles or the like between the application of glue by the first gluing device and the label box.

A modification is shown in FIG. 2. In the latter, as in the variation according to FIG. 1, the bottles 2 move by way of the turntable 6 in the direction of arrow 5. During the application of glue by the spray nozzles 23 and 24, auto rotation of the bottles 2 does not take place, so that an exactly defined front edge of the glue application is possible and resulting glue strands, which lead to spreading of glue, extend from this edge, seen in FIG. 2, towards the left over the periphery of the bottle 2.

Shortly after the application of glue, the bottle 2 is then rotated about its own axis of rotation 8 by way of the associated rotary plate in the direction of rotation according to arrow 5 of the turntable 6 and as far as is indicated by the third position in FIG. 2.

When the bottle has reached this position, it is located partly already in front of the label box 11 or in front of the first wrap-around label 12 to be removed.

If the rotary plate 7 or the bottle is now turned back in the opposite direction, as indicated by the right-hand position in FIG. 2, then an exact limitation of the glue on the front edge of the label occurs and, above all, it is advantageous that the strands of glue drawn along over the periphery lie in the region of the wrap-around label 12 and thus cannot contribute to impairing the attachment of the label.

This sequence of movements of the bottles 2 or of the rotary plates 7 can again be controlled by a corresponding drive. A drive of this type is illustrated, for example, in FIG. 3. A centering device 26 is provided for better support of the bottle 2 on the rotary plate 7. The rotary plate 7 is mounted in a housing 27, in which, at the same time, transmission gearing 28 adapted to the given conditions is also located, but which is not illustrated in detail and constitutes a compact gear unit. The rotary drive of the rotary plate 7 takes place by way of a shaft 29, which is provided at its lower end with a roller lever 31, which supports a pair of rollers 32, 33. In this case, one roller 32 is guided in an associated cam groove 34 of a cam support 36.

We claim:

1. A labelling machine, comprising:

a turntable rotatable in a given direction and formed with a multiplicity of stations for respective containers to be labelled angularly equispaced about an axis of rotation of said turntable, each of said stations being provided with a respective rotary plate upon which a respective container is to be received, said stations forming an array surrounding said axis of rotation of said turntable;

a label box positioned along said turntable and outwardly of said array provided with a magazine for applying individual wrap-around labels from a stack thereof contained in said magazine to individual ones of said containers as they are rotatably entrained by said turntable past said box and are rotated on their respective plates concurrently with their rotatable entrainment by said turntable past said box;

a first gluing device upstream of said label box in said direction inwardly of said array along said turntable and including at least one hot-melt glue-spray nozzle located within a path of said containers entrained by said turntable and trained outwardly and directly upon the containers entrained along said path for applying a hot-melt glue to each container, the hot-melt glue on each container causing a leading end of a respective wrap-around label from said label box to adhere to the container when each container reaches said label box;

a second gluing device downstream of said label box in said direction along said turntable and positioned to apply glue to a trailing end of a label adapted to adhere last to the respective container to bond to a leading end of the label whereby said trailing end can overlap and bond to said leading end; and means downstream of said second gluing device along said path for pressing said labels against said containers as said containers are rotated on the respective plates and are entrained along said path beyond said second gluing device.

2. The labelling machine defined in claim 1 wherein said first gluing device comprises two alternately effective hot-melt glue-spray nozzles located within said path of said containers entrained by said turntable and trained outwardly upon the containers entrained along said path for applying said hot-melt glue to each container.

3. The labelling machine defined in claim 2, further comprising means operatively connected with said plates for preventing said plates from rotating while the respective containers thereon are juxtaposed with said nozzles.

4. The labelling machine defined in claim 1, further comprising means operatively connected with said plates for causing said plates with respective containers thereon to rotate in a direction opposite the direction of rotation of said turntable downstream along said path from said first gluing device.

5. The labelling machine defined in claim 1, further comprising means operatively connected with said plates for causing said plates with respective containers thereon to rotate in a direction which is the same as the direction of rotation of said turntable between said first gluing device and said label box, and then causing said plates to rotate in a direction opposite to said direction of rotation of said turntable for removing a respective label from said box.

6. The labelling machine defined in claim 1 wherein said plates are each provided with a compact gear unit surrounded by a housing with a corresponding set of transmission gears for rotating said plates selectively in a direction which is the same as the direction of rotation of said turntable and in a direction which is opposite to the direction of rotation of said turntable at different regions along said path.

7. The labelling machine defined in claim 1 wherein said plates are each provided with a centering device for supporting the respective containers thereagainst.

* * * * *